US008176656B2

(12) United States Patent
Bae et al.

(10) Patent No.: US 8,176,656 B2
(45) Date of Patent: May 15, 2012

(54) LAUNDRY DRYER

(75) Inventors: Sang Hun Bae, Changwon-si (KR); Jung Wook Moon, Changwon-si (KR); Chul Jin Choi, Changwon-si (KR); Dong Hyun Kim, Changwon-si (KR); Young Bok Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 563 days.

(21) Appl. No.: 12/309,401

(22) PCT Filed: Jul. 18, 2007

(86) PCT No.: PCT/KR2007/003478

§ 371 (c)(1),
(2), (4) Date: Jan. 16, 2009

(87) PCT Pub. No.: WO2008/010671

PCT Pub. Date: Jan. 24, 2008

(65) Prior Publication Data

US 2009/0320313 A1 Dec. 31, 2009

(30) Foreign Application Priority Data

Jul. 18, 2006 (KR) ..... 10-2006-0067014
Jul. 18, 2006 (KR) ..... 10-2006-0067015
Jul. 18, 2006 (KR) ..... 10-2006-0067016
Aug. 2, 2006 (KR) ..... 10-2006-0072898

(51) Int. Cl.
*F26B 11/02* (2006.01)
*F26B 25/18* (2006.01)
*F26B 25/06* (2006.01)

(52) U.S. Cl. ..... 34/603; 34/237; 34/667

(58) Field of Classification Search ..... 34/603, 34/192, 193, 194, 171, 178; 68/48, 12.18, 68/171, 208
See application file for complete search history.

(56) References Cited

U.S. PATENT DOCUMENTS 3,788,581 A * 1/1974 Rutzick ..... 248/678
6,026,988 A * 2/2000 Teetsel et al. ..... 222/88
7,356,945 B2 * 4/2008 Choi et al. ..... 34/597
2003/0150704 A1 * 8/2003 Posada ..... 203/1
2004/0231371 A1 11/2004 Scheper et al.
2005/0050644 A1 3/2005 Severns et al.
2005/0274157 A1 * 12/2005 Yang ..... 68/17 R
2006/0037213 A1 2/2006 Kajihara et al.
2008/0202154 A1 * 8/2008 Salt ..... 62/498

FOREIGN PATENT DOCUMENTS

DE 43 04 532 A1 8/1994

(Continued)

*Primary Examiner* — Kenneth Rinehart
*Assistant Examiner* — John McCormack
(74) *Attorney, Agent, or Firm* — McKenna Long Aldridge LLP

(57) ABSTRACT

The present invention relates to a laundry dryer having an improved structure, which can remove wrinkles of laundry during a drying cycle after washing. A dryer includes a cabinet in which various parts are installed; a drum rotatably mounted in the cabinet, the drum holding laundry therein; a heater that heats air to supply hot air to the drum; a steam generator that generates steam to supply the steam to the drum; a water container that has an outlet to supply water to the steam generator; a water supply path provided between the steam generator and the water container; and a contact prevention part that prevents the remaining water of the water container or the water supply path from contacting with the various parts provided in the cabinet, wherein the remaining water is the water remaining in the water container or the water supply path when the water container is detached from the water supply path.

21 Claims, 11 Drawing Sheets

FOREIGN PATENT DOCUMENTS

| | | | |
|---|---|---|---|
| EP | 1441059 A1 * | 7/2004 | |
| EP | 1 666 655 | 6/2006 | |
| JP | 2000018782 A * | 1/2000 | |
| WO | WO 90/15951 | 12/1990 | |

* cited by examiner

[Fig. 1]
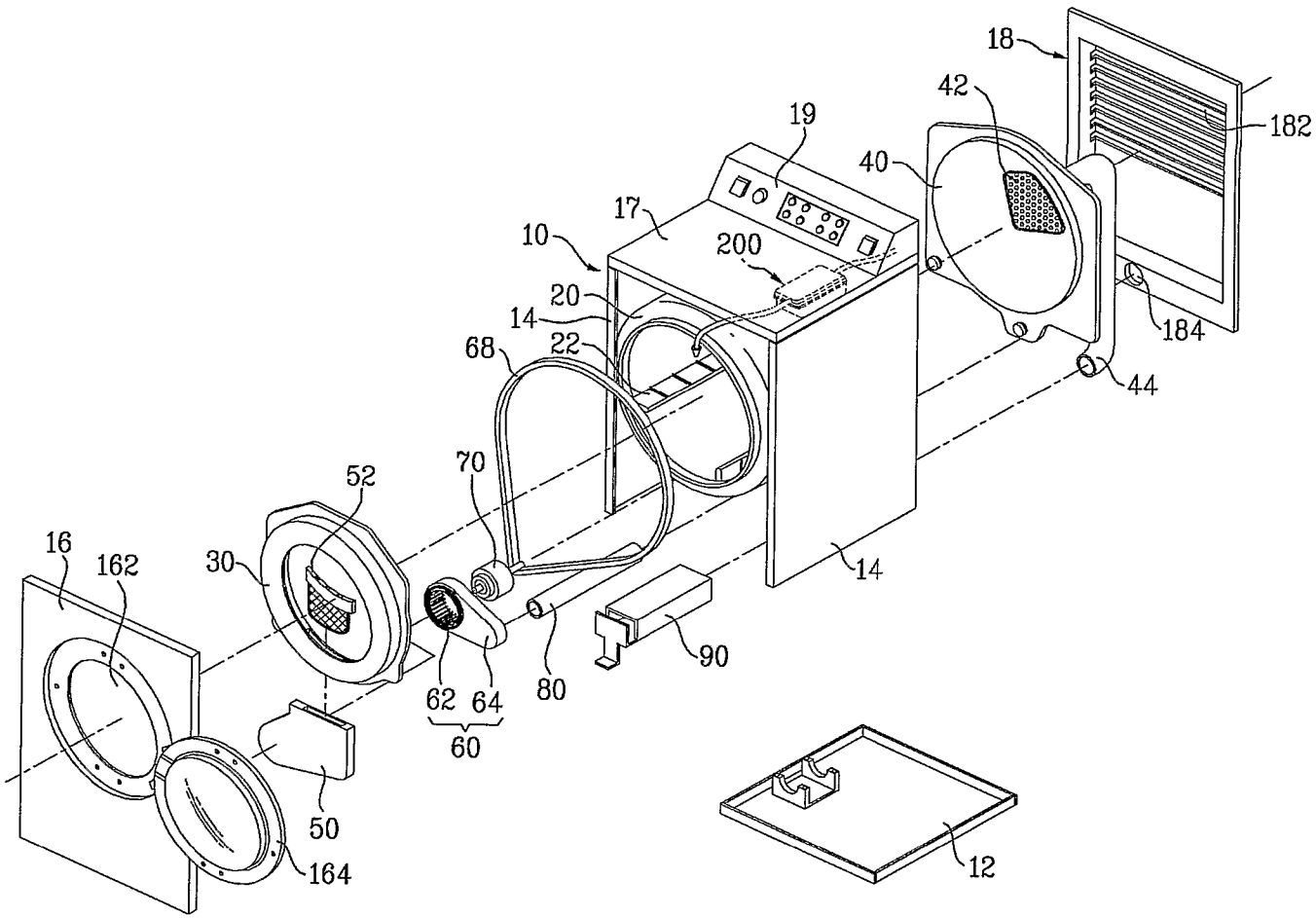

[Fig. 2]
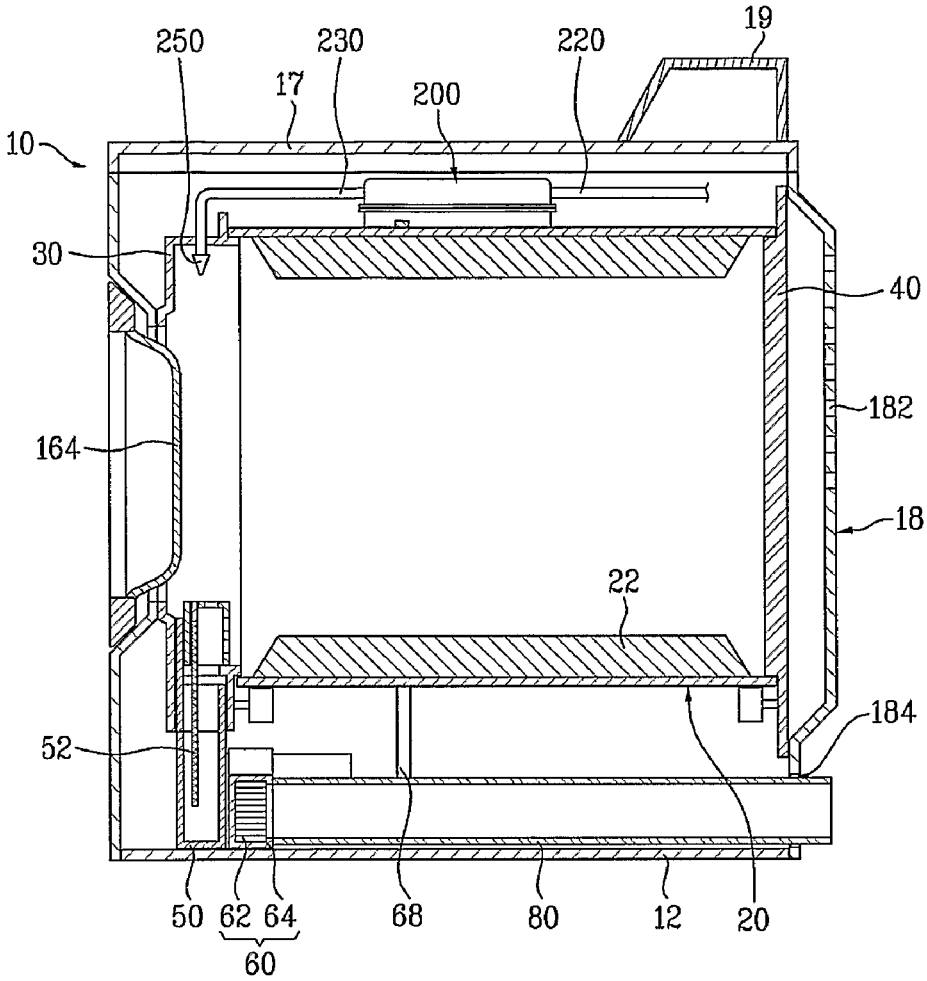
[Fig. 3]
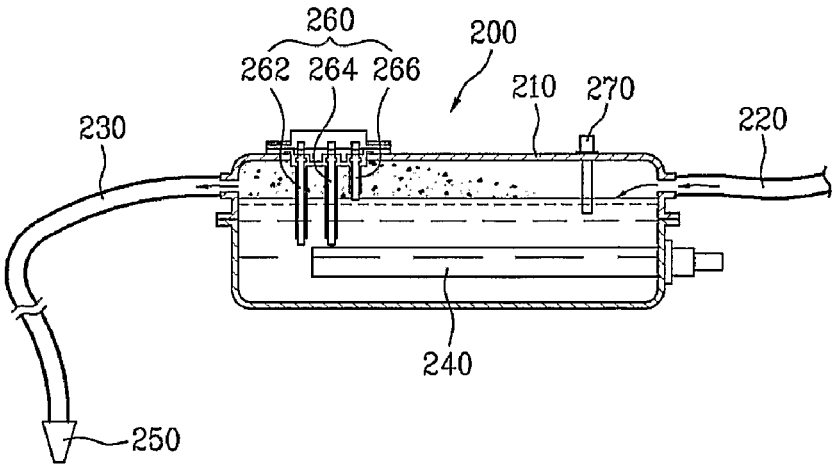

[Fig. 4]
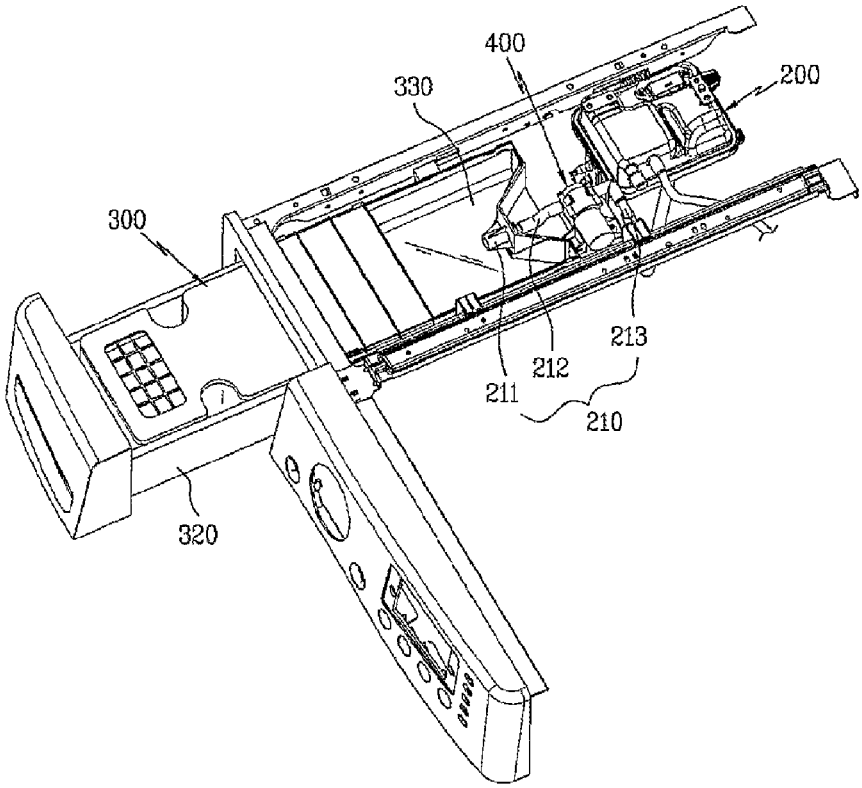
[Fig. 5]
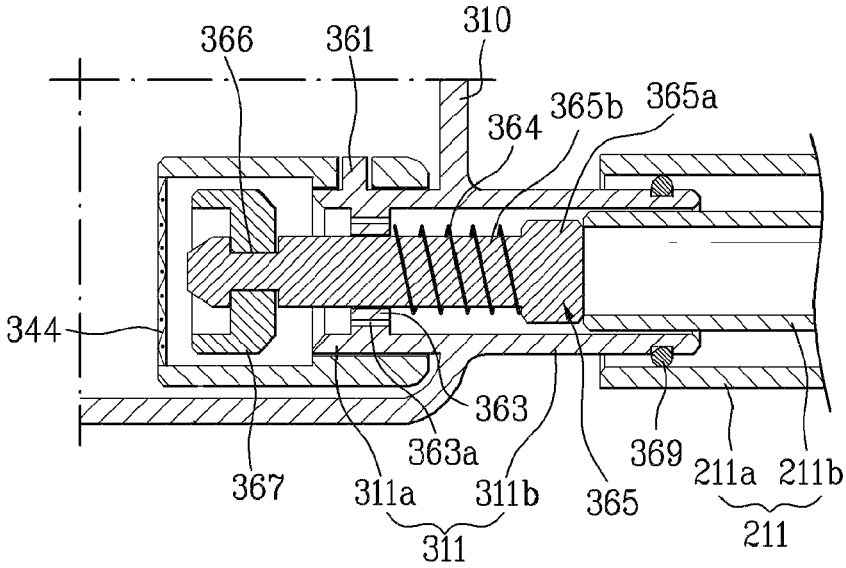

[Fig. 6]
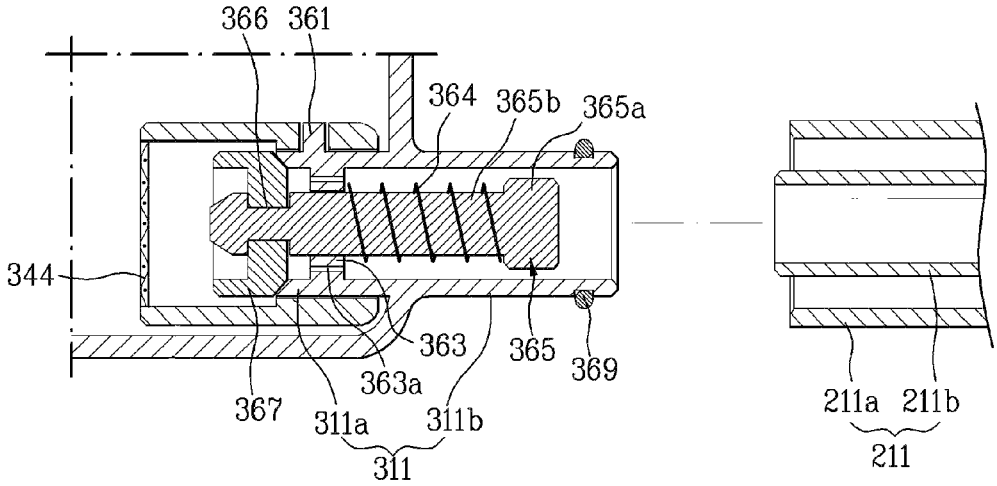
[Fig. 7]
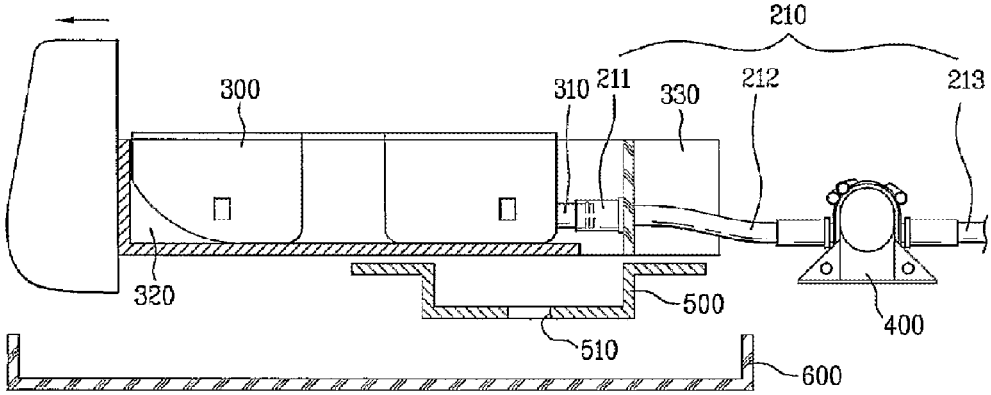

[Fig. 8]
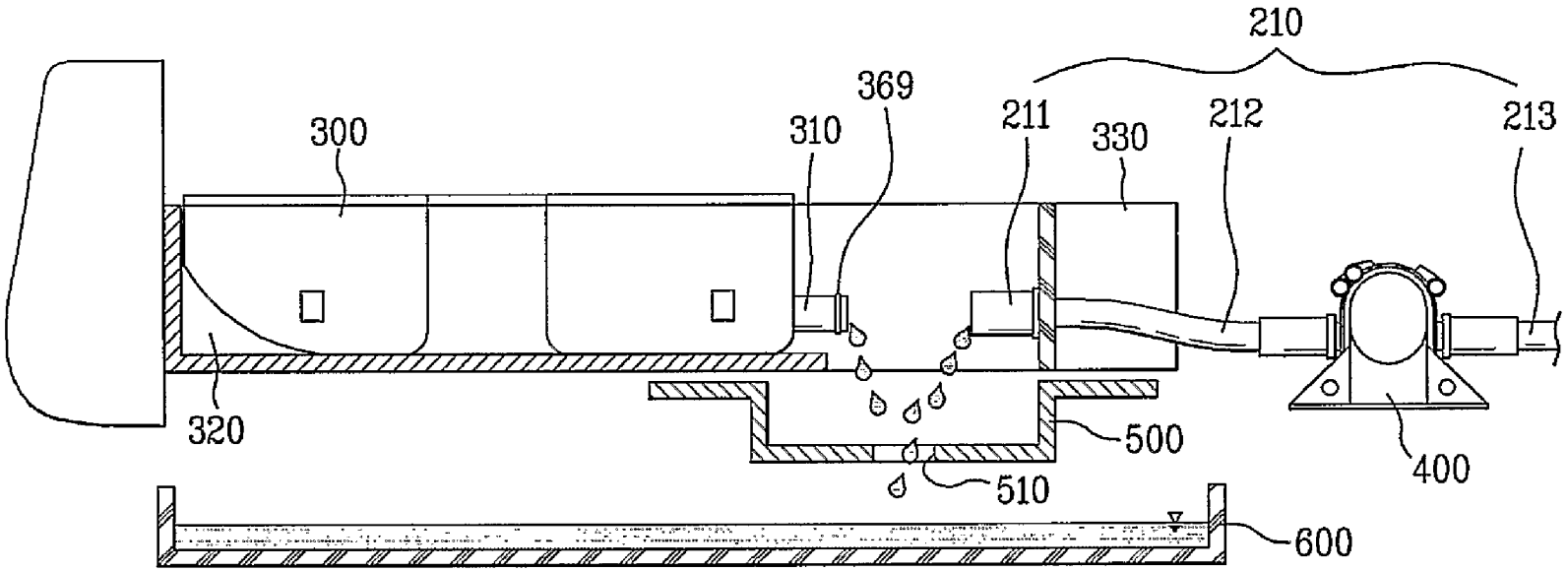

[Fig. 9]
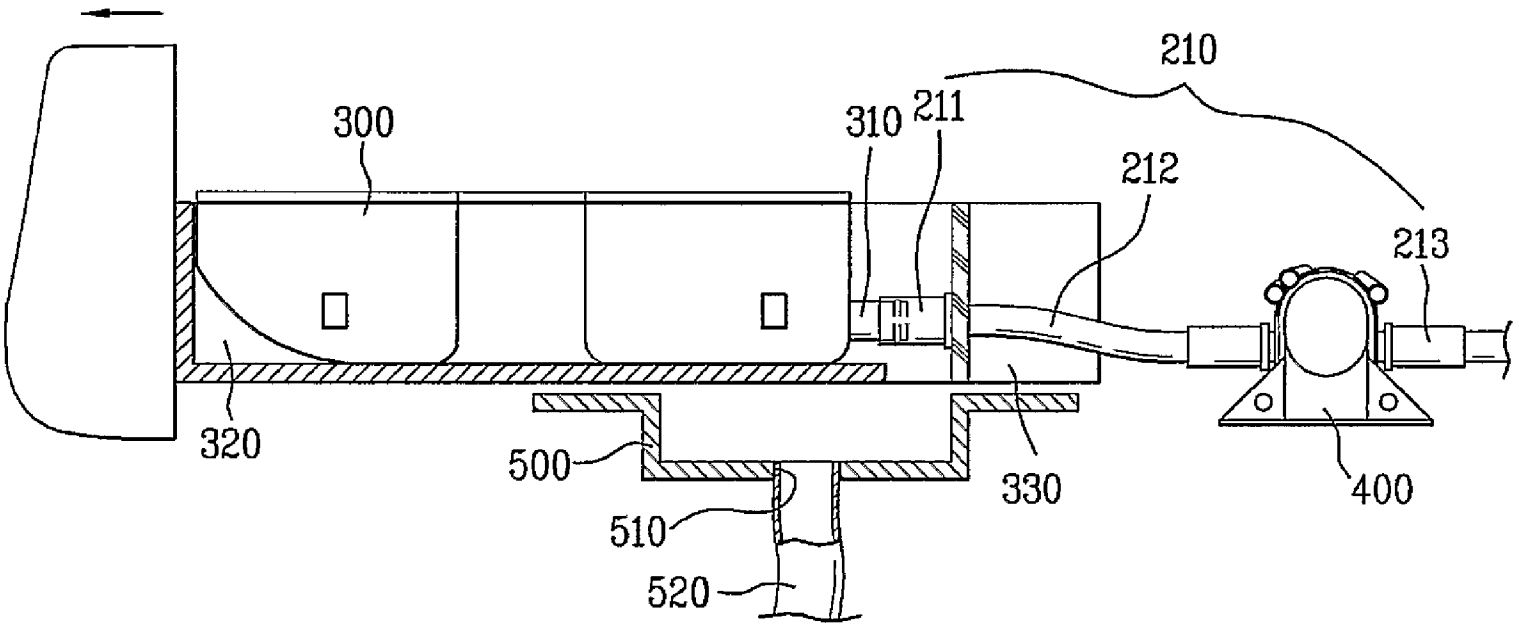

[Fig. 10]
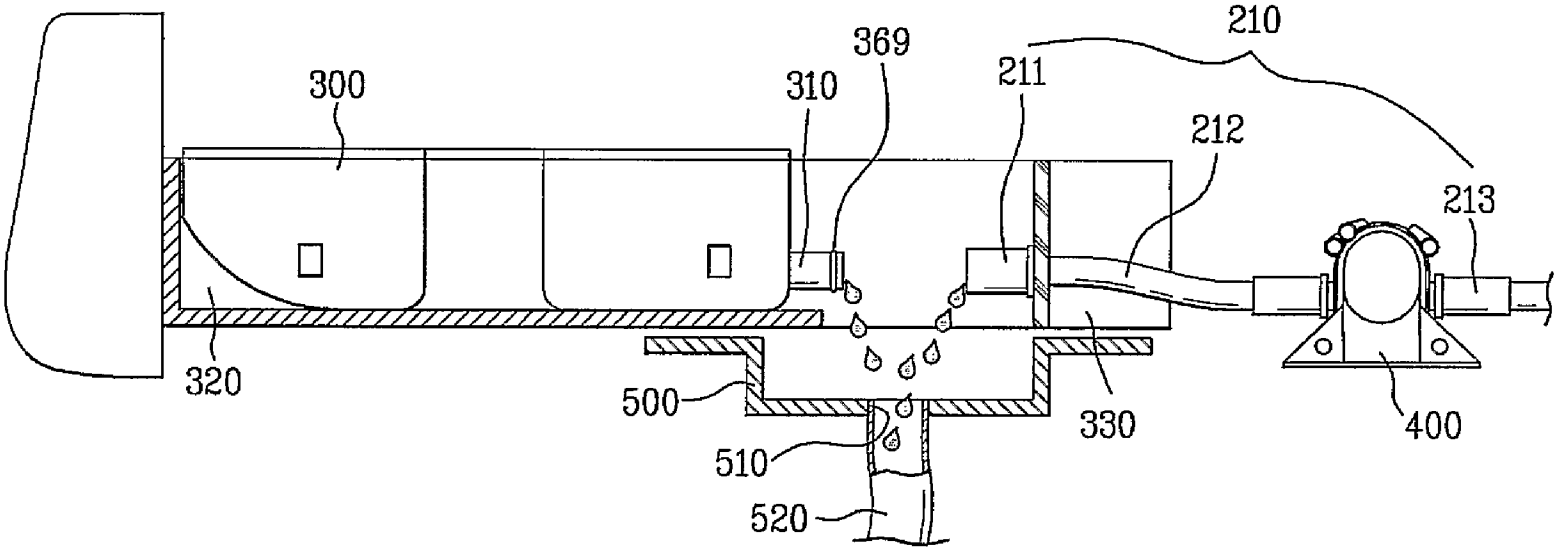

[Fig. 11]
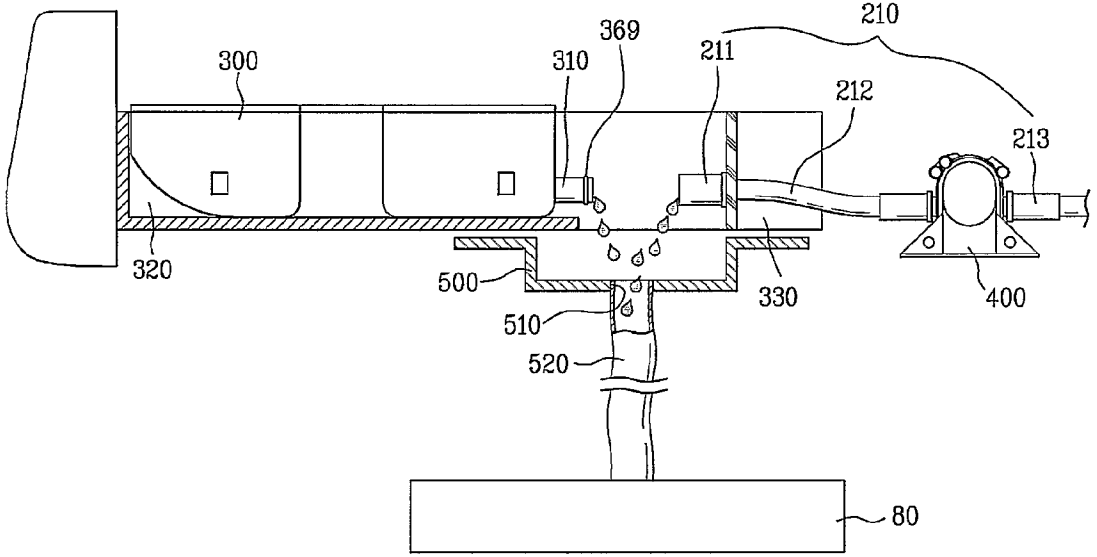
[Fig. 12]
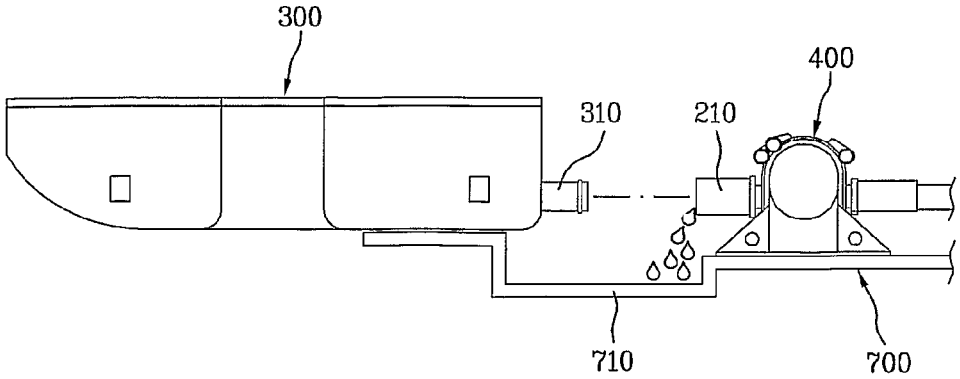

[Fig. 13]
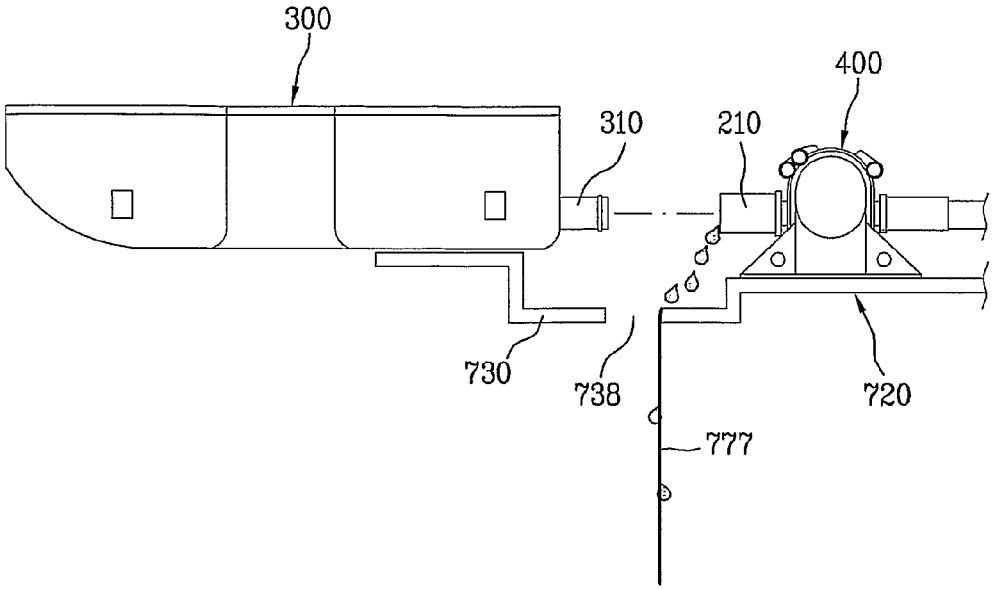
[Fig. 14]
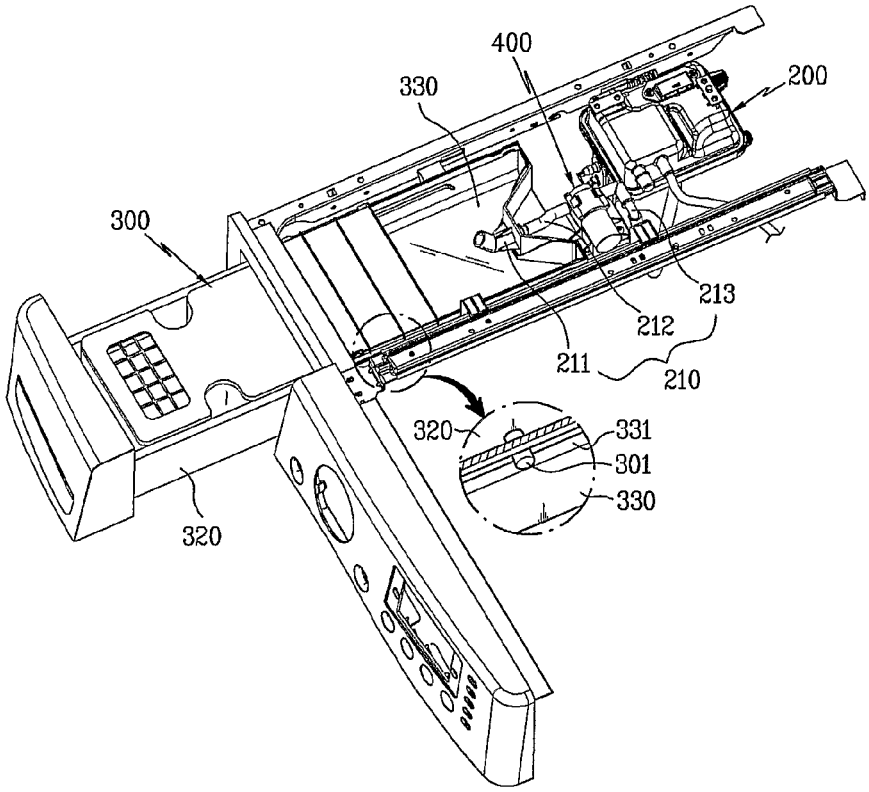

[Fig. 15]
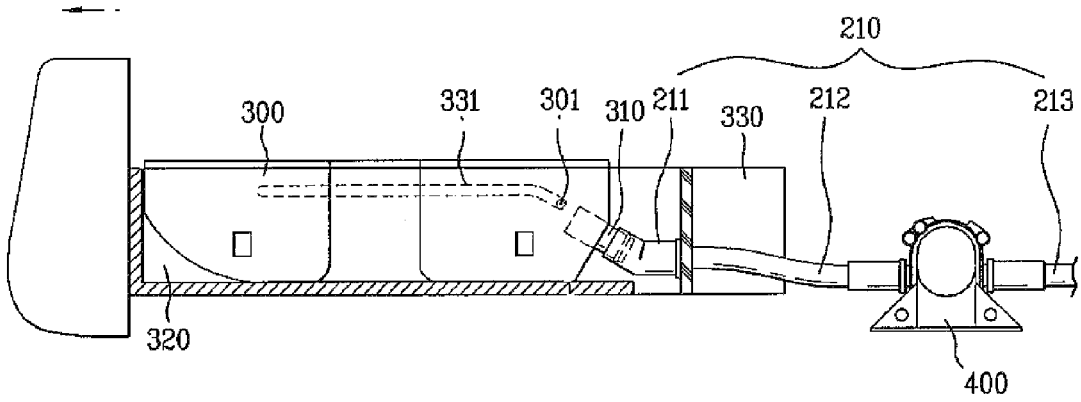

[Fig. 16]
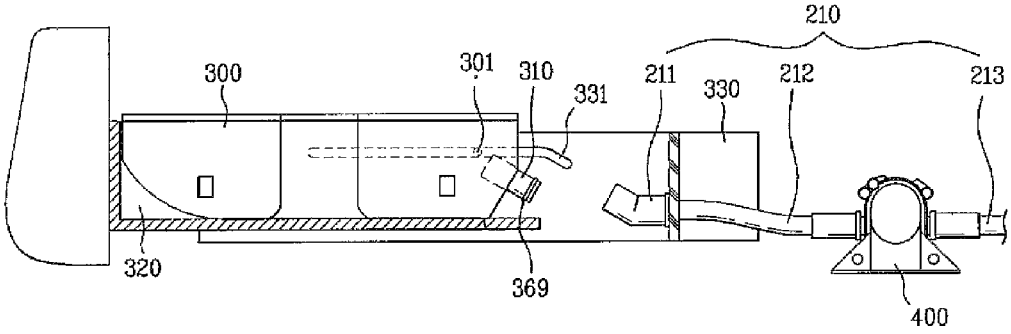

LAUNDRY DRYER

This application is a 35 USC §371 national stage entry of International Application No. PCT/KR2007/003478, filed on Jul. 18, 2007, and claims priority to Korean Patent Application Numbers: 10-2006-0067014, filed Jul. 18, 2006; 10-2006-0067015, filed Jul. 18, 2006; 10-2006-0067016, filed Jul. 18, 2006; and 10-2006-0072898, filed Aug. 2, 2006, all of which are hereby incorporated by reference herein in their entireties.

TECHNICAL FIELD

The present invention relates to a laundry dryer. More specifically, the present invention relates to a laundry dryer having an improved structure, which can remove wrinkles of laundry during a drying cycle after washing.

BACKGROUND ART

Dryers are typically appliances that dry washed laundry, especially, clothes by using high temperature air.

Such dryers are configured of a drum, a driving source, heating means and a blower unit. The drum holds the laundry therein and the driving source drives the drum. The heating means heats air supplied to the drum and the blower unit generates a ventilation force for circulating the air inside the drum.

The dryers may be categorized, based on a method of heating air that is a heating means, into gas-type dryers and electricity-type dryers.

The electricity-type dryers use electric resistance heat to heat air, while the gas-type dryers use heat generated by gas combustion.

On the other hand, the dryers may be categorized into condensation-type dryers and exhaustion-type dryers.

In the condensation-type dryer, air is heat-exchanged with laundry in the drum and the damp air is circulated, not discharged outside. Hence, the air is heat-exchanged at an auxiliary condenser to condense the air and discharge the condensed water outside.

While, in the condensation-type dryer, air is heat-exchanged with laundry in a drum and the damp air is directly discharged outside the dryer.

The dryers may be also categorized, based on a method of loading laundry into drums, into top loading type dryers and front loading type dryers.

In the top loading dryer, laundry is loaded into a drum through a top of the dryer. While, in the front loading type dryer, laundry is loaded into a drum through a front of the dryer.

DISCLOSURE OF INVENTION

Technical Problem

Commonly, laundry that has had washing and spinning complete is loaded in such dryers and the laundry is dried according to a drying course.

At this time, the washed laundry has wrinkles in a view of a water washing principle and the wrinkles of laundry still remain even after the drying course.

As a result, conventional dryers have a problem that additional ironing is necessary to remove the wrinkles of the laundry. to solve the problem, demands for development of dryers having a steam supply device have been increasing and accordingly corresponding development of various devices have been increasing to perform installation work of such steam supply devices.

Technical Solution

To solve the problems, an object of the present invention is to provide a laundry dryer which can remove wrinkles of laundry during a drying cycle after washing.

To achieve these objects and other advantages and in accordance with the purpose of the invention, as embodied and broadly described herein, a dryer includes a cabinet in which various parts are installed; a drum rotatably mounted in the cabinet, the drum holding laundry therein; a heater that heats air to supply hot air to the drum; a steam generator that generates steam to supply the steam to the drum; a water container that has an outlet to supply water to the steam generator; a water supply path provided between the steam generator and the water container; and a contact prevention part that prevents the remaining water of the water container or the water supply path from contacting with the various parts provided in the cabinet, wherein the remaining water is the water remaining in the water container or the water supply path when the water container is detached from the water supply path.

The contact prevention part comprises a remaining water holding part provided below a connection portion between the water container and the water supply path to receive the remaining water. A water drain hole is formed at the remaining water holding part and the remaining water is drained through the water drain hole.

A water storage part is provided below the water drain hole and the water drained from the water drain hole is stored in the water storage part. The water storage part is a draw type that is movable forward and rearward.

A water drain path through which the water stored in the remaining water holding part is discharged is provided under the water drain hole. It is preferable that the water drain path is configured of a flexible tub. The dryer further includes an exhaustion duct through which hot air inside the drum is exhausted outside the cabinet, wherein the water drain path is connected to the exhaustion duct.

The contact prevention part may be configured of a predetermined portion of the water supply path connected to the outlet that is bent upward. Here, a predetermined portion of the water container where the outlet is formed is oblique downward to be connected to an upper portion of the water supply path.

Guide protrusions are further formed at both opposite sides of the drawer, respectively, and guide parts are further provided at both opposite sides, each guide part having a sliding groove for guiding the guide protrusion. An end of the sliding groove close to the water supply path is bent downward to the water supply path.

The dryer may further include a pump provided at the water supply path.

The dryer may further includes a pump that pumps water to the steam generator from the water container; and a pump bracket in which the pump is installed, wherein a predetermined portion of the pump bracket recessively bent downward forms the remaining water holding part.

The contact prevention part may be configured of an evaporation inducting means that the remaining water flows along to enlarge a surface area of the remaining water and to perform evaporation.

ADVANTAGEOUS EFFECTS

The present invention has following advantageous effects.

First, according to the dryer of the present invention, the steam generator is provided in the dryer and after the laundry is dried in the dryer, wrinkles may not be generated on the laundry. In addition, the laundry can be sterilized and bad smell of the laundry can be removed.

Furthermore, the water supply source for supplying water to the steam generator is detachably provided in the dryer. As a result, auxiliary other devices for supplying water to the steam generator do not have to be provided in the dryer and the production cost may be low.

A still further, the contact prevention part is installed at the water container and the water supply path. As a result, when the water container is detached from the water supply path, the remaining water of the water container or the water supply path can be prevented from falling to the parts provided in the cabinet. Since the water is not contacted with the parts, rust may not be generated on the parts and usage life of the parts may be prolonged.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings:

FIG. 1 is an exploded perspective view illustrating a dryer according to an embodiment of the present invention;

FIG. 2 is a longitudinally sectional view of FIG. 1;

FIG. 3 is a sectional view illustrating a steam generator according to the embodiment;

FIG. 4 is a perspective view illustrating key parts of a dryer according to the present invention;

FIGS. 5 and 6 are sectional views illustrating before and after a water container is detached from a water supply path, respectively, to explain connection between the water container and the water supply path;

FIGS. 7 and 8 are sectional views illustrating a contact prevention part according to the embodiment of the present invention, respectively;

FIGS. 9 to 11 are diagrams illustrating a contact prevention part according to another embodiment of the present invention, respectively;

FIGS. 12 to 13 are sectional views illustrating a contact prevention part according to a further embodiment of the present invention, respectively; and FIGS. 14 to 16 are diagrams illustrating a contact prevention part according to a still further embodiment of the present invention.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

In reference to FIGS. 1 and 2, a dryer according to an embodiment of the present invention includes a cabinet 10, a drum 20, a motor 70 and a belt 68. The cabinet 10 defines an exterior of the dryer and the drum 20 is rotatably mounted in the cabinet 10. The motor 70 and the belt 68 operate the drum 20.

A heater 90 (hereinafter, a hot air heater) is provided in a predetermined portion of the cabinet 10 to heat air such that the air is changed into high temperature air (hereinafter, hot air), and a hot air supply duct 44 is installed in a predetermined portion of the cabinet 10 to supply the hot air generated at the hot air heater 90 to the drum 20.

There are provided in the cabinet 10 an exhaustion duct 80, a blower unit 60 and a steam generator 200. Damp air that is heat-exchanged with laundry in the drum 20 is discharged outside through the exhaustion duct 80. The blower unit 60 sucks the damp air. The steam generator 200 generates high temperature steam.

Although this embodiment presents on convenience sake an indirect driven type dryer in that the drum 20 is rotated by using the motor 70 and the belt 68, the present invention is not limited thereto. That is, the present invention may be applicable to a direct driven type dryer in that a motor is directly connected to a rear of the drum 20 to directly rotate the drum 20.

Next, each above configuration will be explained in detail.

The cabinet 10 defines an exterior appearance of the dryer and it includes a base 12, a pair of side covers 14, a front cover 16, a rear cover 18 and a top cover 17. The base 12 defines a bottom surface of the cabinet 10. The pair of the side covers 14 are perpendicular from the base 12. The front cover 16 and the rear cover 18 are provided at a front and a rear of the base 12, where the side covers 14 are not provided, respectively. The top cover 17 is provided at an upper surface of the covers 16 and 18.

A control panel 19 having operational switches and other operational parts are provided at the top cover 17 or the front cover 16. A door 164 is coupled to the front cover 16.

An air inlet 182 and an air outlet 184 are provided at the rear cover 18. External air is drawn into the drum 20 through the air inlet 182 and the air inside the drum 20 is discharged outside through the air outlet 184. It is preferable that a lifter 22 is provided in the drum 20 to lift and drop the laundry, such that drying efficiency is improved.

A front supporter 30 and a rear supporter 40 are provided between the drum 20 and the cabinet 20, especially, between the front cover 16 and the rear cover 18.

The drum 20 is rotatably mounted between the front supporter 30 and the rear supporter 40. A sealing member (not shown) is provided between the front supporter 30 and the drum 20 and between the rear supporter 40 and the drum 20 to prevent water leakage.

That is, the front supporter 30 and the rear supporter 40 close a front surface and a rear surface of the drum 20, respectively, to form a drying chamber as well as to support a front and a rear of the drum 20.

An opening is formed at the front supporter 30 to make the drum 20 in communication with an outside and the opening is selectively opened and closed by the door 164. A lint duct 50 is connected to the front supporter 30 as a path through which the air inside the drum 20 is discharged outside, and a lint filter 52 is installed at the lint duct 50.

Here, a side of the blower unit 60 is connected to the lint duct 50 and the other opposite side of the blower unit 60 is connected to the exhaustion duct 80. The exhaustion duct 80 is in communication with the air outlet 184 provided at the rear cover 18.

As a result, once the blower unit 60 is operated, the air inside the drum 20 is discharged outside through the lint duct 50, the exhaustion duct 80 and the air outlet 184.

At this time, foreign substances including lint are filtered by the lint liter 52. Commonly, the blower unit 60 is configured of a blower 62 and a blower housing 64. The blower 62 is typically operated, being connected to the motor 70 driving the drum 20.

An opening 42 is formed at the rear supporter 40 and the opening 42 is configured of a plurality of through-holes. The hot air supply duct 44 is connected to the opening 42. The hot air supply duct 44 is in communication with the drum 20 to be employed as a passage for supplying hot air to the drum 20. Thus, a hot air heater (not shown) is provided in a predetermined portion of the hot air supply duct 44.

In the meantime, the steam generator 200 is provided in the predetermined portion of the cabinet 10 to generate and supply steam to the drum 20, as mentioned above.

In reference to FIG. 3, the steam generator 200 will be explained.

The steam generator 200 includes a water tank 210, a heater 240, a water level sensor 260 and a temperature sensor 270. Water is held in the water tank 210 and the heater 240 is mounted in the water tank 210. The water level sensor 260 senses a water level inside the water tank 210 and the temperature sensor 270 senses a temperature of the water held in the water tank 210.

The water sensor 260 is configured of a common electrode 262, a low water level electrode 264 and a high water level electrode 264. A low water level and a high water level are sensed by whether an electric current is flowing between the common electrode 262 and the high water level electrode 264 or between the common electrode 262 and the low water level electrode 266.

A water supply path 220 through which water is supplied is connected to a predetermined side of the steam generator 200 and a steam hose 230 is connected the other opposite side of the steam generator 200. It is preferable that a nozzle 250 is installed at an end of the steam hose 230 to enhance steam injection efficiency.

Commonly, the water supply hose 220 of the steam generator 200 is connected to an external water supply source such as a water tap installed at an outside the dryer and water is supplied to the water tank 210 as the amount of water supply is controlled by an auxiliary controller.

However, such kind of the steam generator is efficient to an appliance like a washer that needs a lot of water and it is less efficient to a dryer that needs a predetermined amount of water only for steam generation at the steam generator.

That is, if auxiliary devices including a water supply hose, a controller and the like are installed in the dryer that needs the predetermined amount of water, installation cost might be high, which is inefficient as a water supply source for supplying water to the dryer.

As a result, as shown in FIG. 4, the present invention presents an embodiment in that a detachable water supply source is provided at the steam generator 200.

As shown in FIG. 4, there are provided in the steam generator 200 a detachable water container 300 as a water supply source and a water supply path 210 for supplying water to the steam generator 200 from the water container 300.

A predetermined space is formed in the water container 300 and a predetermined amount of water is held in the space. An outlet 310 (see FIG. 5) through which water is discharged to the water supply path 210 is formed at a predetermined portion of the water container 300. Here, the outlet 310 is detachably connected to the water supply path 210.

It is preferable that the water container 300 is retractable and mounted at a drawer 320.

At this time, a guide part 330 is provided in an inside of the dryer to guide the drawer 320 to the water supply path 210.

The water supply path 210 is a path through which the water discharged from the water container 300 is supplied to the steam generator 200 and it is provided between the water container 300 and the steam generator 200.

At this time, it is preferable that a pump 400 is installed at the water supply path 210 to help the water of the water container 300 be supplied to the steam generator 200.

The water may be supplied to the steam generator 200 from the water container 300 by using water level difference but the parts of the dryer are mass-produced and compact such that space is not enough structurally. As a result, if the sizes of the parts are not changed, it is substantially impossible to supply water by using the water level difference. Thus, it is preferable that the pump 400 with a small size is installed at the water supply path 210 to facilitate the smooth water supply.

If the pump 400 is installed, the water may be smoothly supplied to the steam generator 200 from the water container 300 and the water may be drawn into the water tank 210 from the steam generator 200. In case that the steam generator 200 is not used for a relatively long time, the heater 240 might be damaged or the water might be contaminated inside the steam generator 200.

Here, the water supply path 210 includes a connection hole 211, a water supply pipe 213 and a connection pipe 212. The connection hole 211 is provided at the guide part 330, corresponding to the outlet 310 of the water container 300. The water supply pipe 213 is connected between the pump 400 and the steam generator 200. The connection pipe 212 is connected between the pump 400 and the connection hole 211.

Next, in reference to FIGS. 5 and 6, the connection between the water container and the connection hole will be explained.

A path 311 is formed at the outlet 310 of the water container 300 and a pin 365 is provided to selectively open and close the path 311.

The path 311 is configured of an inner path 311*a* projected inward to the water container 300 and an outer path 311*b* provided outward to the water container 300. In addition, an O-ring 369 is provided at an outer surface of the outer path 311*b*.

A recess 366 is formed at a predetermined portion of a body 365*b* of the pin 365 and the recess 366 is recessed in a circumferential direction of the body 365, and a projected part 365*a* is formed at the other opposite portion of the body 365*b* and the projected part 365*a* is projected convexly in a circumferential direction of the body 365*b*.

A closable part 367 having a diameter larger than a diameter of the inner path 311*a* is provided at the recess 366 to open and close the inner path 311*a*. The projected part 365*a* is formed approximately in a cross shape such that the water inside the water container 300 may flow in the connection hole 211 through an aperture formed between cross wings.

In addition, a support 363 is provided in the path 311 to support the body 365*b* of the pin 365 in a radial direction and a plurality of through-holes are formed at the support 363. A spring 364 is provided between the support 363 and the projected part 365*a* of the pin 365.

The connection hole 211 formed at the end of the water supply path 210 is configured of an outer part 211*a* and an inner part 211*b*. The outer part 211*a* has a larger diameter than an outer diameter of the outer path 362*b* and the inner part 211*b* has a smaller diameter than an inner diameter of the outer path 211*b*.

As shown in FIG. 5, when the drawer 320 is moving rearward to an inside the dryer to supply water to the steam generator 200, the drawer 320 is pushed to the steam generator 200 along the guide part 330. As a result, the outlet 310 of the water container 300 is close to the connection hole 211 installed at the guide part 330.

Hence, the pin 365 in the outlet 310 is moving forward in a direction of the inner path 311*a* against the elasticity of the spring 364. As a result, the closable part 367 installed at the pin 365 is separated from the front end of the inner path 311*a* and water is flowing through the aperture, such that the water of the water container 300 is flowing toward the pump 400 through the path 311.

On the other way, when the drawer 320 is pulled forward to re-supply the water to the water container 300 or to drain the water from the steam generator 200, the closable part 367 installed at the pin 365 closes the front end of the inner path 311*a* because of the restitution of the spring 364. As a result, the water inside the water container 300 may not flow in the path 311 further.

However, water is remaining in the outer path 311*b* and the connection hole 211 of the outlet 310. As a result, the remaining water of the outer path 311*b* and the connection hole 211 might fall in the dryer.

If the remaining water falls in the dryer, the water is on the various parts of the dryer and causes rust. Thus, usage life of the parts may be shortened. To prevent that, a contact prevention part is provided to prevent from contacting the various parts of the dryer the remaining water discharged from the water container 300 or the water supply path 210 when the water container 300 is detached from the water supply path 210.

FIGS. 7 and 8 illustrate a contact prevention part according to an embodiment of the present invention.

As shown in FIG. 7, the contact prevention part according to the embodiment includes a remaining water holding part 500 and a water storage part 600. The remaining water holding part 500 is provided below a connection portion between the water container 300 and the water supply path 210 to receive remaining water. The water storage part 600 receives and stores the water from the remaining water holding part 500. the reason why the remaining water holding part 500 is provided is to prevent the remaining water from splashing out of the remaining water holding part 600 due to the height difference among the connection hole 211, the outlet 310 and the water storage part 600, if the remaining water discharged from the outlet 310 of the water container 300 and the connection hole 211 falls directly to the water storage part 600.

A water drain hole 510 is formed at a base of the remaining water holding part 500 and the remaining water is drained through the water drain hole 510. It is preferable that the surface of the base is oblique downward toward the water drain hole 510, which results in the smooth drain of the remaining water toward the water drain hole 510.

The water storage part 600 is provided below the water drain hole 510 to store the water drained through the water drain hole 510.

It is preferable that the water storage part 600 is a drawer type retractable from a front of the dryer to empty the water when a predetermined amount of the water is stored in the water storage part 600. At this time, a handle may be formed at a front portion of the water storage part 600 exposed to the front of the dryer to allow a user to draw or pull smoothly by using the handle.

As shown in FIG. 8, although the water container 300 is detached from the connection hole 211 to expose the water container 300 out of the dryer, the remaining water may be stored in the water storage part 600 via the remaining water holding part 500.

Hence, a user separates the water storage part 600 from the dryer in a predetermined time period to empty the water of the water storage part 600 outside the dryer.

While the water storage part 600 is provided below the remaining water holding part 500 in the above embodiment, a water drain path 520, as shown in FIG. 9, may be provided at the water drain hole 510 of the remaining water holding part 500 instead of the water storage part 600. yhe water drain path 520 connected to the water drain hole 510 extends toward an outside of the cabinet 10 and the water of the remaining water holding part 500 is drained outside the cabinet 10 through the water drain path 520.

At this time, it is preferable that the water drain path 520 is formed of flexible material that can selectively change a path way. For example, it can be a tube and may be varied.

Thus, as shown in FIG. 10, although the water container 300 is detached from the connection hole 211 out of the dryer, the remaining water is held in the remaining water holding part 500 and it is drained outside through the water drain path 520 connected to the water drain hole 510.

As a result, the remaining water of the water container 300 or the connection hole 211 is drained outside through the water drain path 520, such that the remaining water may not fall on the various parts installed in the dryer.

In the meantime, as shown in FIG. 11, it is preferable that the water drain path 520 is connected to the exhaustion duct 80 of the dryer.

If the water drain path 520 is directly connected outside of the dryer, the water drain path 520 exposed outside seems to damage the exterior beauty of the dryer. In addition, the exposed water drain path 520 might be contacted by a user or other things and it might result in the water drain path 520 being detached from the remaining water holding part 500.

While, according to the present invention, the water drain path 520 is connected to the exhaustion duct 80 inside the dryer such that the water drain path 520 may not exposed outside the dryer and it results in the dryer according to the present invention operating more efficiently.

FIGS. 12 and 13 illustrate a contact prevention part according to another embodiment of the present invention.

As shown in FIG. 12, in the dryer according to the embodiment of the present invention, there are provided the water container 300 and the water supply path 210 connected to the water container 300 to supply water to the steam generator.

The outlet 310 is provided at the water container 300 and the outlet 310 is connected to the water supply path 210. The pump 400 is provided at the water supply path 210 and thus the water inside the water container 300 is supplied to the steam generator 200. Here, it is preferable that the water supply path 210 is connected to the pump 400 by a clamp.

A pump bracket 700 is provided to fix the pump 400 at the cabinet 10.

The pump bracket 700 extends to the water container 300.

The pump bracket 700 provided under the pump 400 forms a remaining water holding part 710 having a structure bent downward a predetermined height and the remaining water holding part 710 holds remaining water falling when the water container 300 is detached.

That is, the outlet 310 of the water container 300 is separated from the pump 400 and the remaining water not pumped by the pump 400 is discharged.

FIG. 13 illustrates another embodiment of the contact prevention part. According to this embodiment, an evaporation inducting means is provided at the pump bracket 720 provided below the water supply path 210. The remaining water falling when the water container 300 is detached is flowing along the evaporation inducting means and a surface area of the remaining water is enlarged to facilitate evaporation of the water.

Here, the evaporation inducting means is formed of moisture absorption material and it is formed of a general tread.

Although not described, the evaporation inducting means may be cloth having a predetermined width.

If the evaporation inducting means is provided, the remaining water flows along the thread or cloth, being absorbed in the thread or cloth. Flowing along the thread or cloth, the remaining water is evaporated and diffused at the same time.

As shown in FIG. 13, it is preferable that a remaining water holding part 730 is provided below the water supply path 210. The remaining water holding part 730 is recessed and has a through-hole 738.

The evaporation inducting means is connected to the through-hole 738 of the remaining water holding part 730. The remaining water flows along the evaporation inducting means and the surface of the remaining water is enlarged for evaporation.

Here, the pump bracket 720 is bent downward to form the remaining water holding part 730 as one body.

The evaporation inducting means is configured of a through-hole 738 and an induction band 777 formed of moisture absorbing material. The through-hole 738 is formed at the pump bracket 720 below the connection portion between the water container 300 and the pump 400. The remaining water flows along the induction band 777.

Although not described, the tread or cloth as the evaporation inducting means may be directly attached to a portion where the water supply path 210 is separated. As a result, when the water supply path 210 is separated, the water directly flows along the evaporation inducting means configured of the thread or cloth to perform evaporation by flow and diffusion of water.

FIGS. 14 to 16 illustrate a contact prevention part according to a further embodiment of the present invention. Here, the structures of the outlet 310 formed at the water container 300 and of the connection hole 211 are identical to those of the above embodiments, and thus their detailed explanation will be omitted.

As shown in FIG. 14, guide protrusions 301 projected outward are formed at both opposite sides of the drawer 320. The guide protrusion 301 is guiding means for guiding the drawer 320 when the drawer 320 is moved forward from and rearward to the dryer. In addition, a sliding groove 331 is formed in the guide part 330 that covers each side of the drawer 320 and the guide protrusion 301 of the drawer 320 is sliding along the sliding groove 331.

The sliding groove 331 is formed in a longitudinal direction from the guide part 330 and an end of the sliding groove 331 is bent downward.

That is, the guide protrusion 301 of the drawer 320 is sliding along the sliding groove 331 linearly into the dryer and sling downward along the sliding groove 331 bent at its end.

In addition, an end of the connection hole 211 of the water supply path 210 connected to the outlet 310 is bent upward.

As a result, when the outlet 310 of the water container 300 is detached from the connection hole 211 of the water supply path 210, the remaining water in the connection hole 211 is prevented from falling outside.

As the connection hole 211 is bent upward, the remaining water in the connection hole 211 is not discharged outside.

Because of the configuration of the connection hole 211, the outlet 310 of the water container 300 is bent downward to correspond to the connection hole 211. The end of the sliding groove 331 is bent downward to allow the outlet 310 connected to the connection hole 211 smoothly.

Next, in reference to FIGS. 15 and 16, an operation of the contact prevention means shown in FIG. 14 will be explained.

As shown in FIG. 15, when the drawer 320 is moved rearward into the dryer to supply water to the steam generator 200, the drawer 320 is moving along the guide part 330 linearly and it is moving downward at a portion near the connection hole 211 along the bent portion of the sliding groove 331.

Together with that, the outlet 310 of the water container 300 is inserted in the connection hole 211 installed at the guide part 330.

At this time, the pin 365 in the outlet 310 is moving forward in a direction of the inner path 311*a* against the elasticity of the spring 364. as a result, the closable part 367 installed at the pin 365 is separated from the end of the inner path 311*a* and the water of the water container 300 flows through the aperture created by the separation, such that the water of the water container 300 may flows toward the pump 400 through the path.

While, when the drawer 320 is moving forward to empty the water of the steam generator 200 as shown in FIG. 16, the outlet 310 of the water container 300 is detached from the connection hole 211 of the water supply path 210 and the closable part 367 of the pin 365 closes the end of the inner path 311*a* by the restitution of the spring 364 in the outlet 310. As a result, the water is discharged from the water container 300.

At this time, the water is remaining in the outlet 310 of the water container 300 and the connection hole 211 of the water supply path 210. However, the connection portion of the connection hole 211 with the connection hole 211 is bent upward. As a result, when the water container 300 is detached from the connection hole 211, the remaining water of the outlet 310 falls to the connection hole 211 and the remaining water of the connection hole 211 is not discharged out of the connection hole 211.

Thus, although the water is remaining in the water supply path 210 during the detaching of the water container 300 from the water supply path 210, the remaining water is not discharged out of the water supply path 210.

The contact prevention part according to the embodiments of the present invention has been explained. However, the contact prevention part is not limited thereto and may be varied in other various embodiments.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Industrial Applicability

The present invention has an industrial applicability. First, according to the dryer of the present invention, the steam generator is provided in the dryer and after the laundry is dried in the dryer, wrinkles may not be generated on the laundry. In addition, the laundry can be sterilized and bad smell of the laundry can be removed.

Furthermore, the water supply source for supplying water to the steam generator is detachably provided in the dryer. As a result, auxiliary other devices for supplying water to the steam generator do not have to be provided in the dryer and the production cost may be low.

A still further, the contact prevention part is installed at the water container and the water supply path. As a result, when the water container is detached from the water supply path, the remaining water of the water container or the water supply path can be prevented from falling to the parts provided in the cabinet. Since the water is not contacted with the parts, rust may not be generated on the parts and usage life of the parts may be prolonged.

The invention claimed is:

1. A laundry dryer comprising:

a cabinet in which various parts are installed;

a drum rotatably mounted in the cabinet, the drum holding laundry therein;

a steam generator to generate steam to supply to the drum;

a water container that has an outlet to supply water to the steam generator;

a water supply path provided between the steam generator and the water container;

a drawer that transfers the water container to the water supply path;

a pump provided at the water supply path and pumping water to the steam generator from the water container;

a contact prevention part that prevents remaining water of the water container or the water supply path from contacting with the various parts provided in the cabinet; and a pump bracket in which the pump is installed, wherein the remaining water is the water remaining in the water container or the water supply path when the water container is detached from the water supply path, wherein the water container is detachably mounted at the drawer, wherein the contact prevention part comprises a remaining water holding part provided below a connection portion between the water container and the water supply path to receive the remaining water, and wherein a predetermined portion of the pump bracket recessively bent downward forms the remaining water holding part.

2. The laundry dryer of claim 1, wherein a water drain hole is formed at the remaining water holding part and the remaining water is drained through the water drain hole.

3. The laundry dryer of claim 2, wherein a water storage part is provided below the water drain hole and the water drained from the water drain hole is stored in the water storage part.

4. The laundry dryer of claim 3, wherein the water storage part is a draw type that is movable forward and rearward.

5. The laundry dryer of claim 2, wherein a water drain path through which the water stored in the remaining water holding part is discharged is provided under the water drain hole.

6. The laundry dryer of claim 5, wherein the water drain path is configured of a flexible tube.

7. The laundry dryer of claim 6, further comprising:

a heater that heats air to supply hot air to the drum; and an exhaustion duct through which hot air inside the drum is exhausted, wherein the water drain path is connected to the exhaustion duct.

8. The laundry dryer of claim 1, wherein the contact prevention part is configured of a predetermined portion of the water supply path connected to the outlet that is bent upward.

9. The laundry dryer of claim 8, wherein a predetermined portion of the water container where the outlet is formed is oblique downward to be connected to an upper portion of the water supply path.

10. The laundry dryer of claim 9, wherein guide protrusions are formed at both opposite sides of the drawer, respectively, and guide parts are further provided at both opposite sides, each guide part having a sliding groove for guiding the guide protrusion.

11. The laundry dryer of claim 10, wherein an end of the sliding groove close to the water supply path is bent downward to the water supply path.

12. The laundry dryer of claim 1, wherein the pump bracket extends to a connection portion between the water container and the pump.

13. The laundry dryer of claim 12, wherein the remaining water holding part is bent downward from the pump bracket below the connection portion between the water container and the pump.

14. The laundry dryer of claim 1, wherein the contact prevention part is configured of an evaporation inducing means that the remaining water flows along to enlarge a surface area of the remaining water and to perform evaporation.

15. The laundry dryer of claim 14, wherein the evaporation inducing means is formed of moisture absorbing material.

16. The laundry dryer of claim 15, wherein the evaporation inducing means is configured of a thread.

17. The laundry dryer of claim 15, wherein the evaporation inducing means is configured of cloth having a predetermined width.

18. The laundry dryer of claim 1, wherein the contact prevention part comprises:

an evaporation inducing means that the remaining water generated when the water container is detached flows along to enlarge a surface area of the remaining water and to perform evaporation, wherein the remaining water holding part is recessively provided below the water supply path where the water container is detached, having a through-hole.

19. The laundry dryer of claim 18, wherein the evaporation inducing means is formed of moisture absorbing material.

20. The laundry dryer of claim 19, wherein the evaporation inducing means is configured of a thread.

21. The laundry dryer of claim 19, wherein the evaporation inducing means is configured of cloth having a predetermined width.

* * * * *